US005823386A

United States Patent [19]

Vandenberg

[11] Patent Number: 5,823,386

[45] Date of Patent: Oct. 20, 1998

[54] REWARD CANDY DISPENSER FOR PERSONAL COMPUTERS

[76] Inventor: Anthony Peter Vandenberg, C-201 Nagamura Mansion 3423-1 7-ku, Kitacho, Japan

[21] Appl. No.: 798,045

[22] Filed: Feb. 10, 1997

[51] Int. Cl.[6] ..... B65D 83/04

[52] U.S. Cl. ..... 221/2; 221/13; 221/155; 221/196; 221/199; 221/203; 221/265; 364/479.02; 364/479.13

[58] Field of Search ..... 364/479.02, 479.13; 221/2, 8, 9, 13, 155, 196, 199, 203, 265

[56] References Cited

U.S. PATENT DOCUMENTS

| | | | |
|---|---|---|---|
| 3,810,535 | 5/1974 | Phipps | 221/265 |
| 4,420,095 | 12/1983 | Galoob | 221/265 |
| 4,903,861 | 2/1990 | Yuymama | 221/265 |
| 5,004,966 | 4/1991 | Eakid | 364/479.02 |
| 5,176,290 | 1/1993 | Schwarzli | 221/203 |
| 5,337,920 | 8/1994 | Claujed | 364/479.13 |

FOREIGN PATENT DOCUMENTS

| | | | |
|---|---|---|---|
| 2592199 | 6/1987 | France | 221/265 |

*Primary Examiner*—H. Grant Skaggs

[57] ABSTRACT

A personal computer peripheral, battery powered reward candy dispenser which immediately presents students with a single candy for each problem completed correctly while using educational application software. The reward candy dispenser compromises: a transparent plastic upper supply compartment with a transparent plastic threaded cap and a transparent plastic lower component compartment base stand; a suction-cup, monitor screen attachable photo-sensor device for detecting a designated personal computer generated light intensity actuation signal; a central controller for receiving, confirming, and converting the actuation signal into a dispense motor activation command; a motor and a transparent plastic gear device for rotating a gravity-fed, multiple-chambered, transparent plastic dispense drum under a transparent plastic chute ceiling and above a transparent plastic chute for controlled dispense; integral dispense drum agitator rods for agitating stored candies and preventing the formation of bridging cavities; a pivoting, drop contact displacement device for detecting the dispense of a single candy and signaling central controller to terminate power to the motor; and a transparent plastic dispense port for the reception of the reward candies.

1 Claim, 11 Drawing Sheets

REWARD CANDY DISPENSER FOR PERSONAL COMPUTERS

BACKGROUND

1. Field of Invention

Figure 1A:
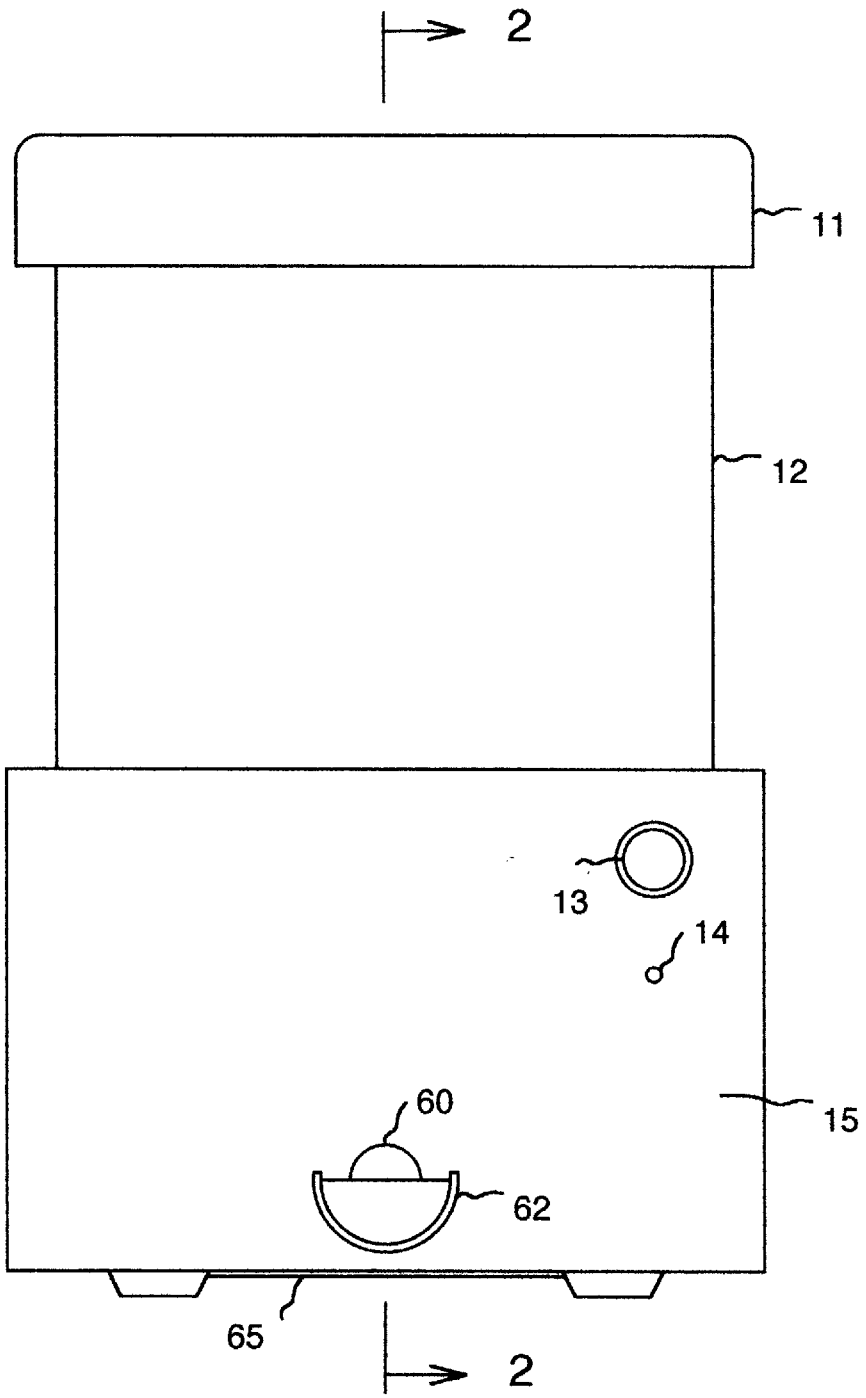

This invention relates to a personal computer peripheral, battery powered reward candy dispensing device utilized for entertaining and motivating students to use educationally oriented application software, specifically by immediately presenting students with a single candy for each problem answered correctly.

2. Description of Related Art

A diversity of educationally oriented commercial copyright software, shareware software, and public domain software exists and can be found in the homes of most owners of personal computers. These educational programs quiz students with questions on a variety of subjects including spelling, language, math, and other subjects. A large percentage of the educational software includes graphic effects, tallying of scores, printed readouts, and special audio effects to reward students upon successful completion of the problem and motivate continuing utilization of the software. However, students frequently become less and less motivated by these pseudo-rewards due to their intangible and repetitive nature. In fact, many students tend to stop using the educational software programs altogether.

OBJECT AND ADVANTAGES

Several objects and advantages of my invention are:

(a) to provide a reward candy dispenser powered by batteries to simplify utilization and free-up normally full electric outlets around the computer area.

(b) to provide a reward candy dispenser powered by batteries to facilitate safe utilization for younger students by eliminating the need to plug into an electric outlet.

(c) to provide a reward candy dispenser that is actuated by an educational software application generated graphic signal on the computer monitor screen thereby eliminating the need to use normally occupied printer and SCSI ports, plug-in cables, connections, and control system software, thereby allowing simple and compatible utilization with any personal computer type which runs educational software.

(d) to provide a reward candy dispenser that is actuated by an educational software application generated graphic signal on the computer monitor screen, thereby allowing product manufacturers, commercial software makers, shareware software makers, and home software makers the freedom to include the designated actuation graphic in the design of their educational software applications.

(e) to provide a reward candy dispenser with a photo-sensor diode element housed in the center of a suction-cup device for simple attachment to the computer monitor screen above a specified actuation graphic signal area;

(f) to provide a reward candy dispenser with a clear supply housing, a clear compartment housing, clear dispense components, and a clear dispense port, so that candy contents and dispense process operations are visible, attractive, educational, and interesting to students;

(g) to provide a reward candy dispenser which directly and immediately rewards students with one candy for each effort completed correctly;

(h) to provide a reward candy dispenser which provides a continuing source of motivation and increases the utilization and effectiveness of educationally oriented software;

Still further objects and advantages will become apparent from a consideration of the ensuing description and drawings.

DRAWING FIGURES

In the drawings, closely related figures have the same number but different alphabetic suffixes. Although the present embodiment of this invention is made from transparent molded thermoplastics, visible objects behind the target object are not shown for greater figure clarity. Conventional electronic details such as terminals, wires and connections are not shown in FIGS. 1 though 8. Essential electronic component information of the present embodiment of this reward candy dispenser has been included in flow chart form in FIGS. 7 and 8.

FIG. 1A: shows a front view of various external aspects of the reward candy dispenser.

Figure 1B:
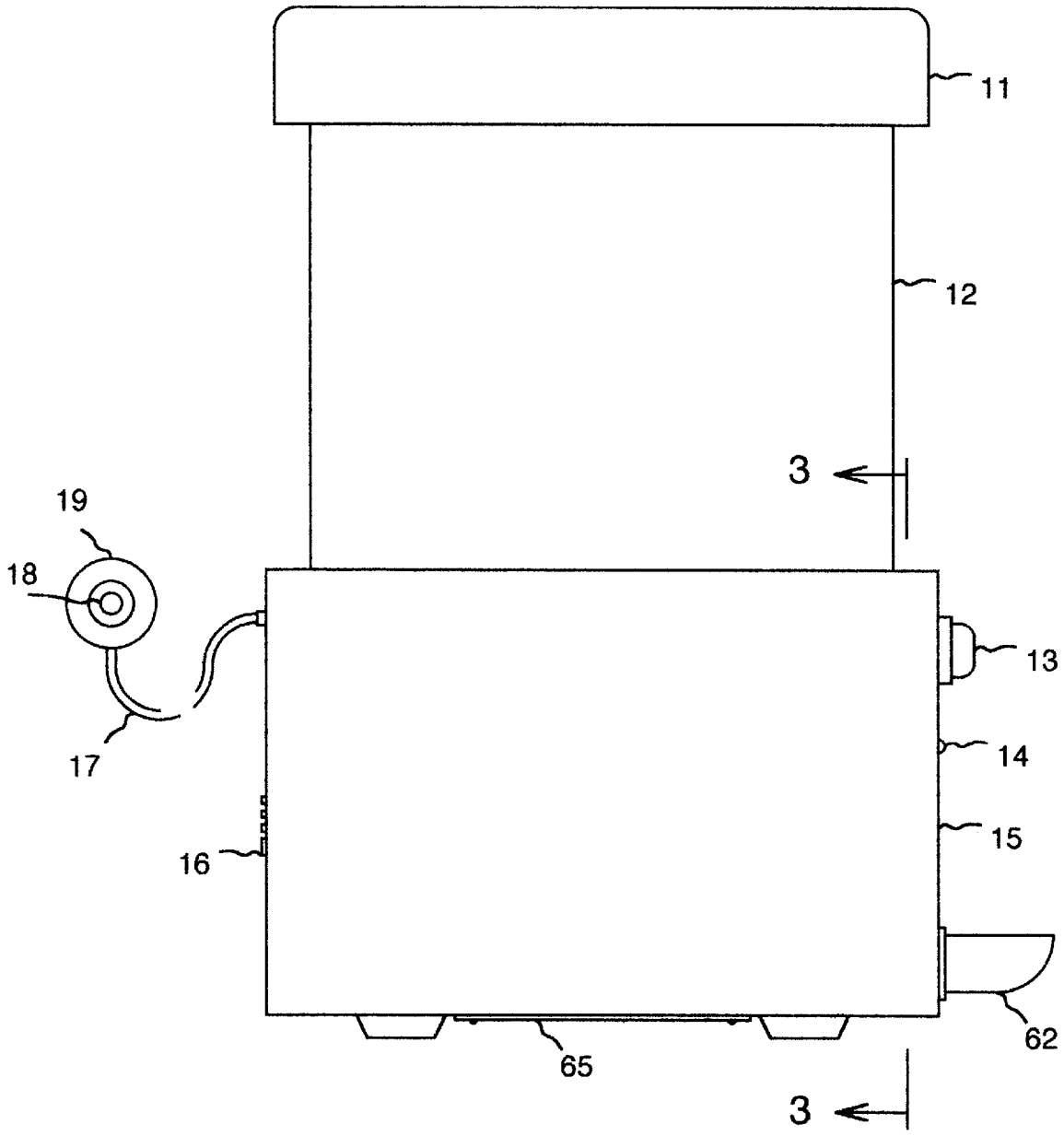

FIG. 1B: shows a side view of various external aspects of the reward candy dispenser.

Figure 1C:
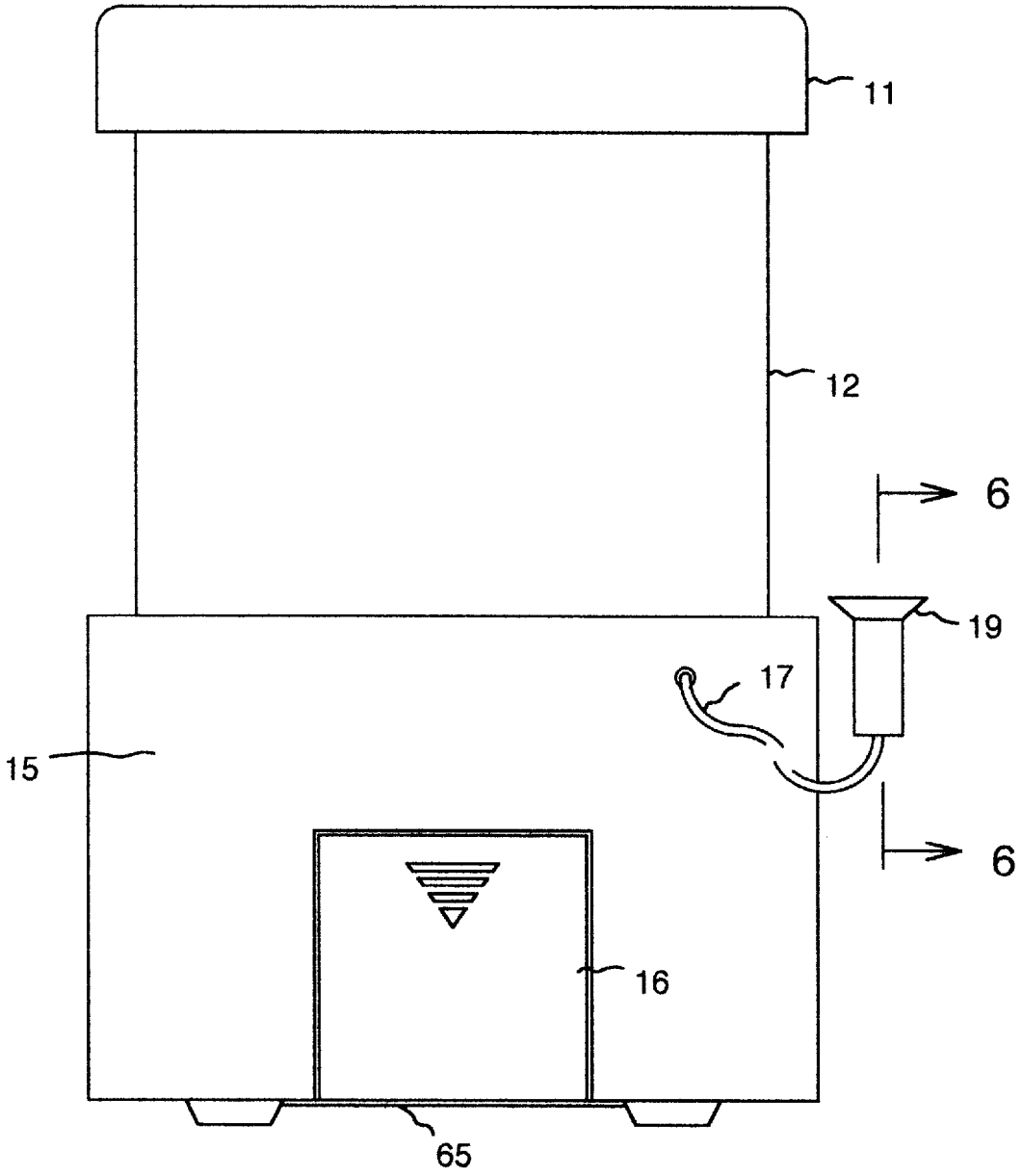

FIG. 1C: shows a back view of various external aspects of the reward candy dispenser.

Figure 1D:
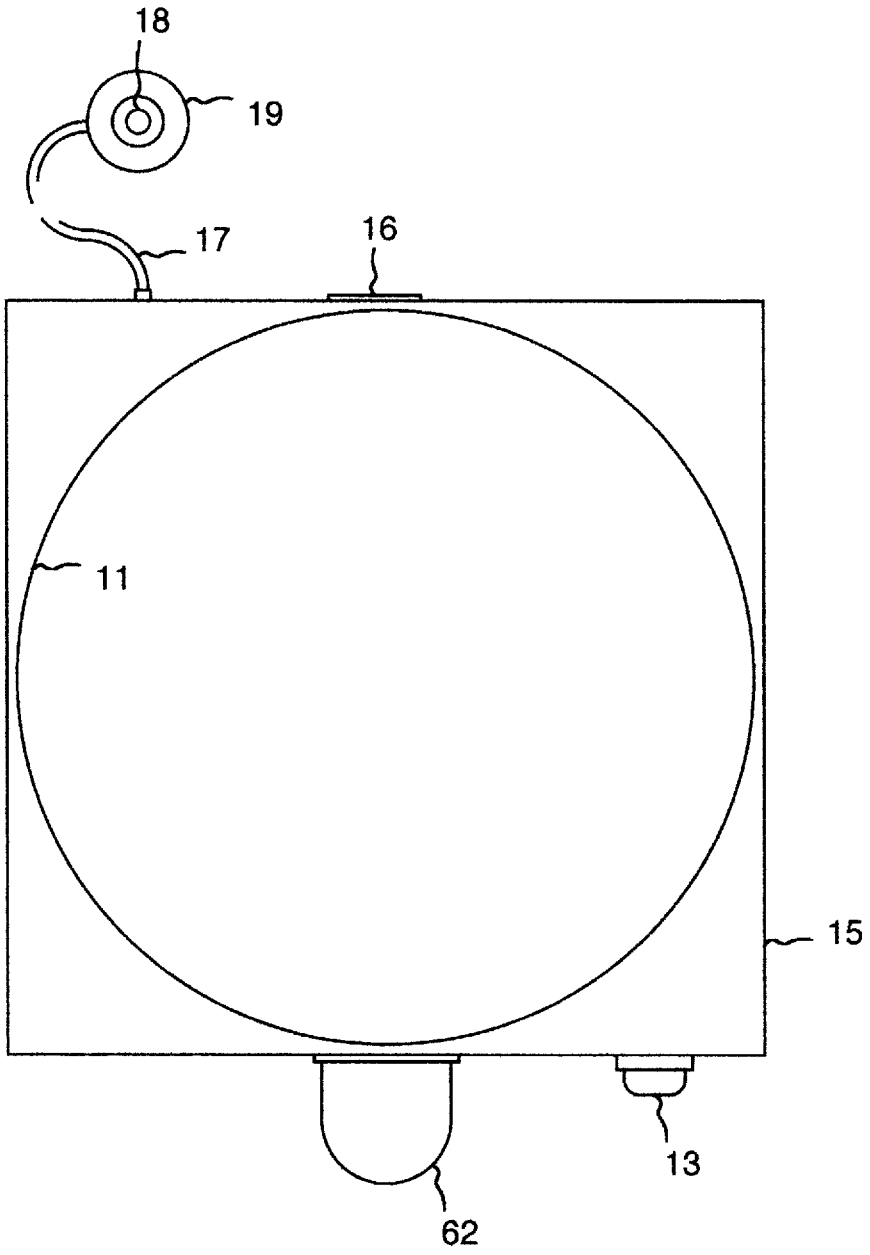

FIG. 1D: shows a top view of various external aspects of the reward candy dispenser.

Figure 2:
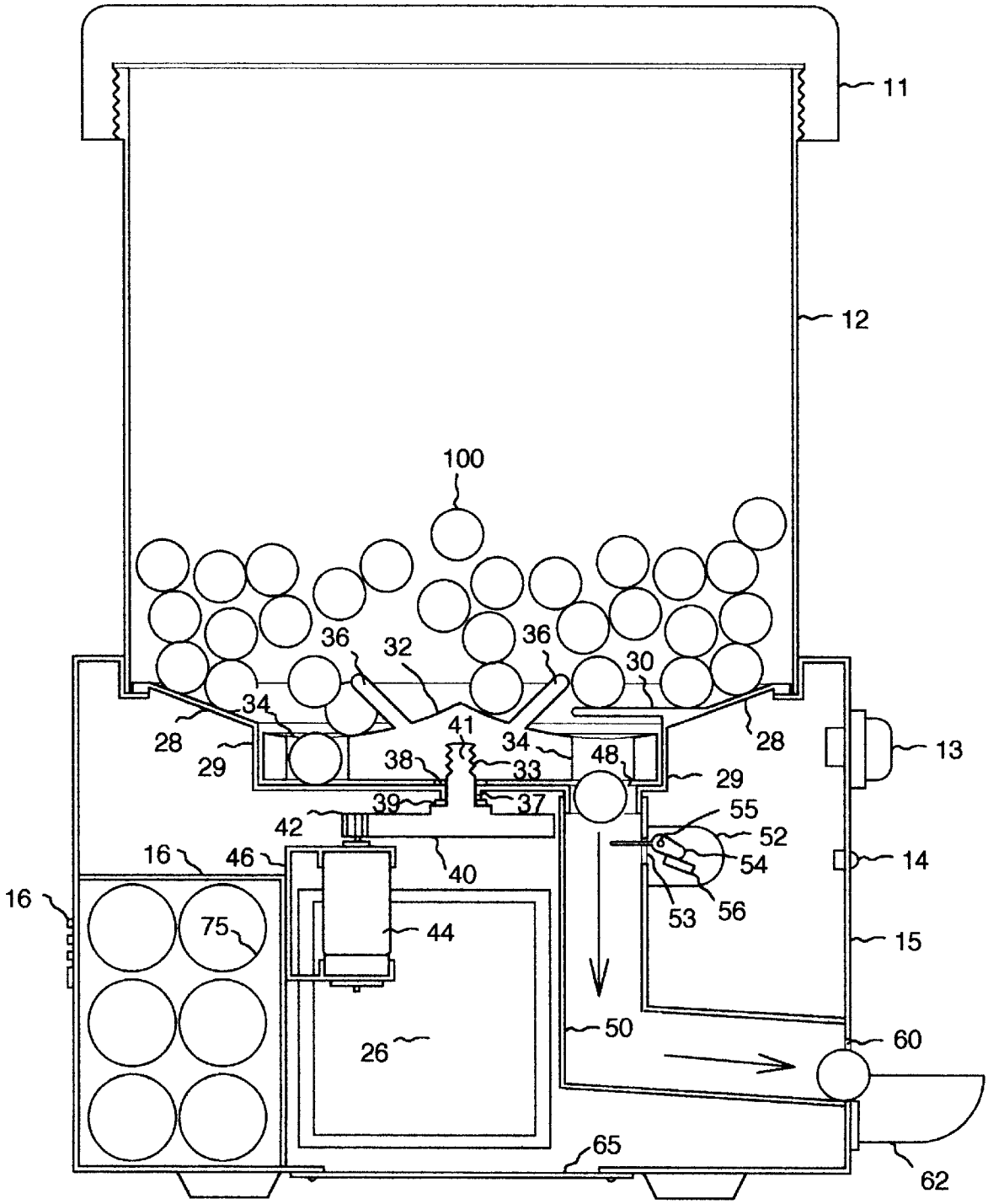

FIG. 2: shows a section view through the center of the reward candy dispenser and various aspects of the dispense mechanisms including representative candies.

Figure 3:
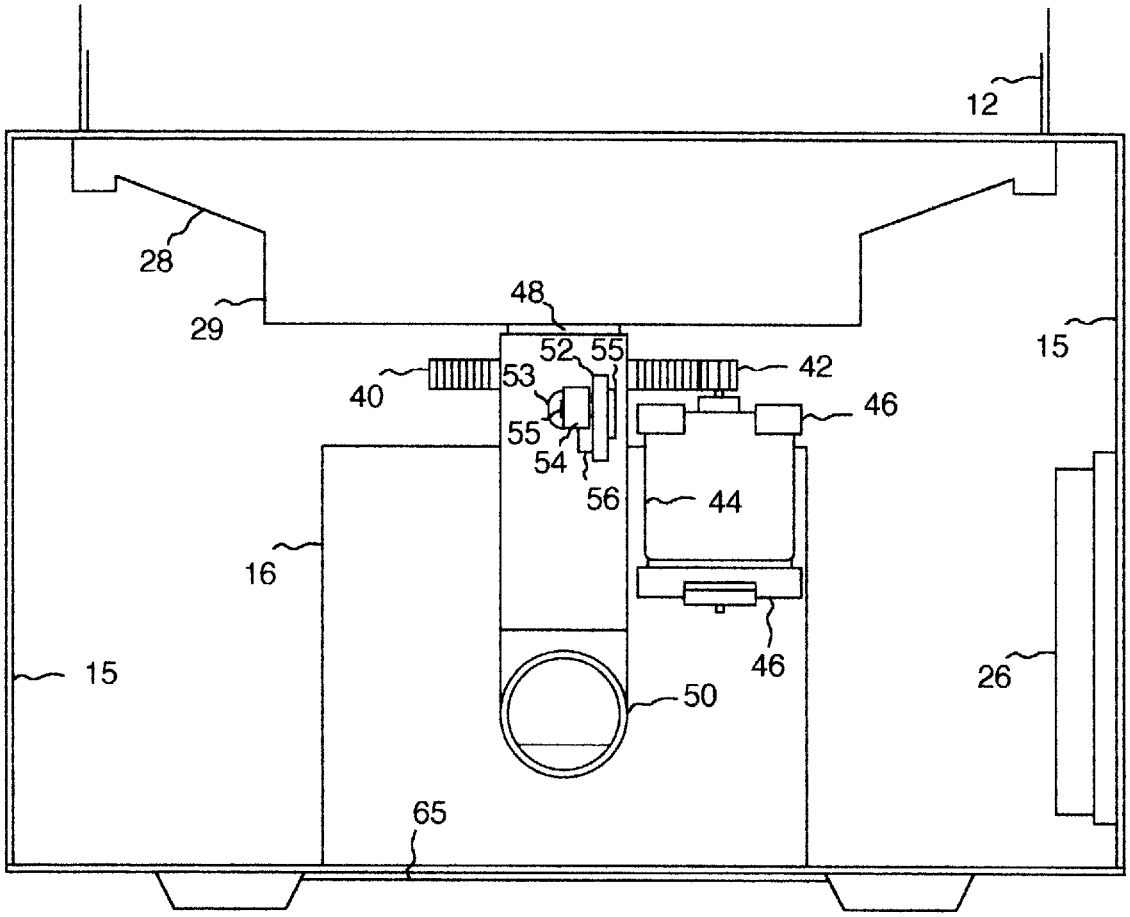

FIG. 3: shows a section view of the reward candy dispenser's component compartment base stand and various aspects of a drop contact displacement device.

Figure 4:
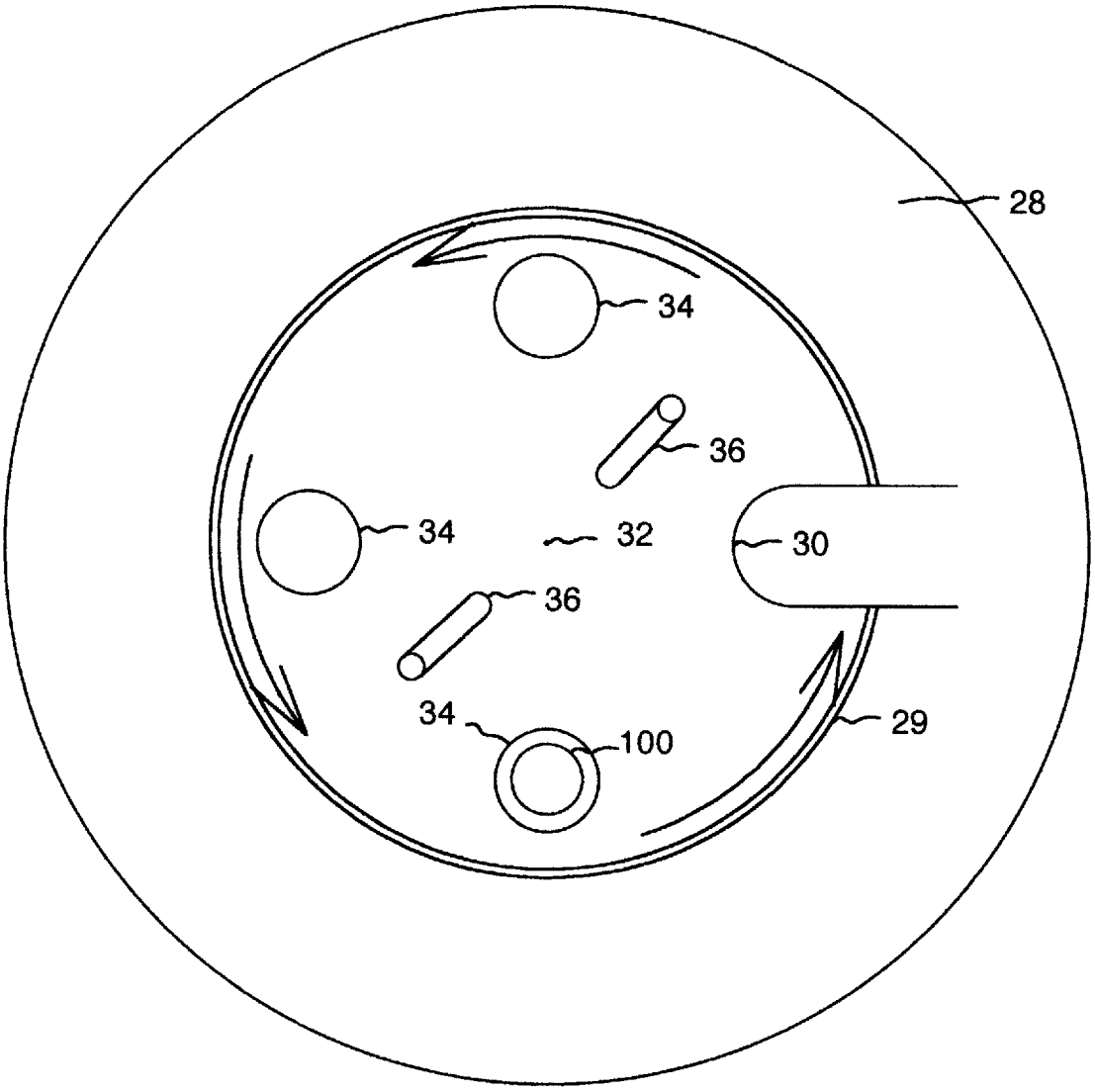

FIG. 4: shows a plan view of the counter-clockwise rotation of a dispense drum with one loaded representative candy about its longitudinal axis.

Figure 5:
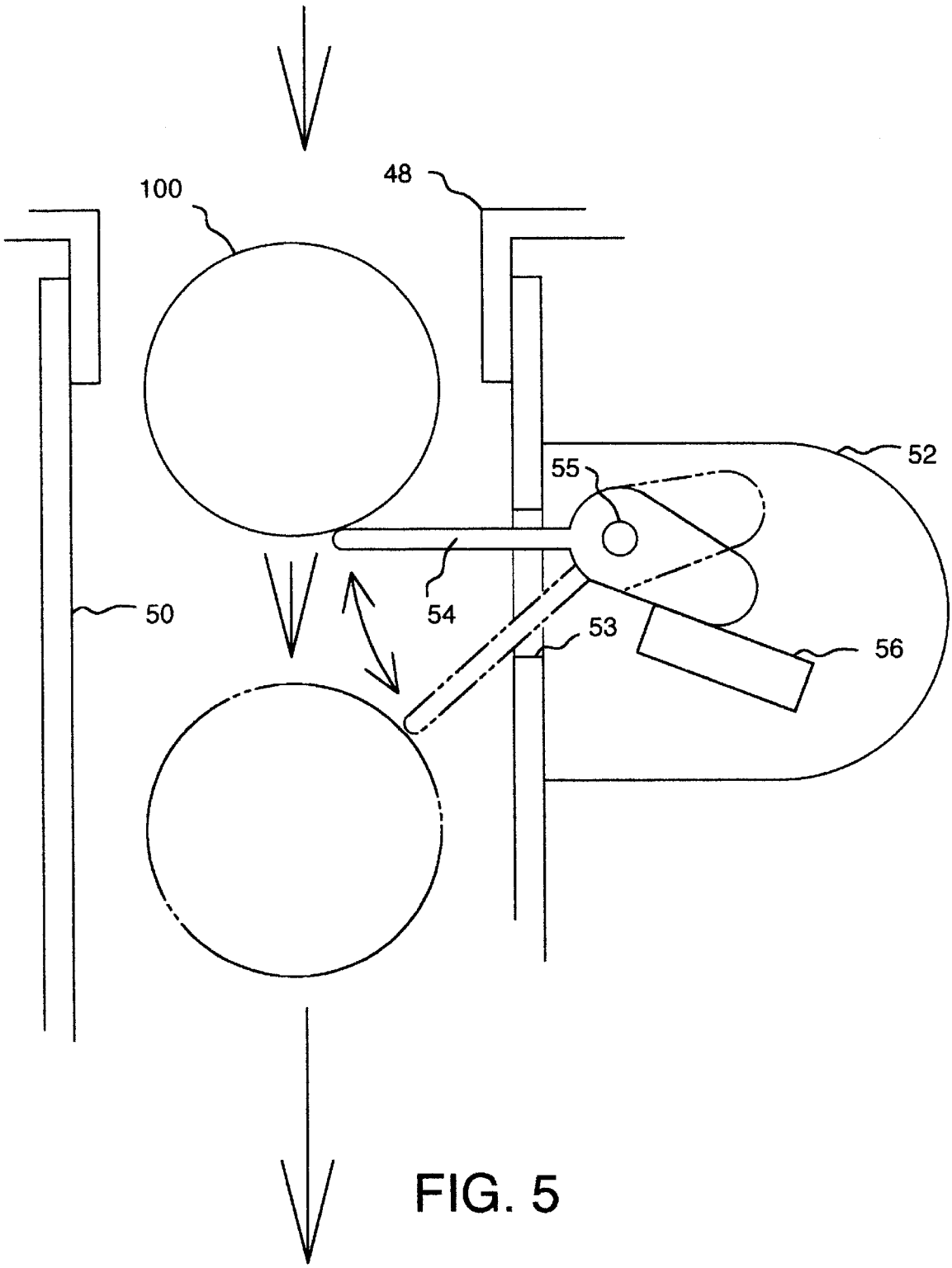

FIG. 5: shows a section view of a chute pipe with the rotational arc movement in phantom of a contact needle being displaced from a metal contact plate by one falling candy.

Figure 6:
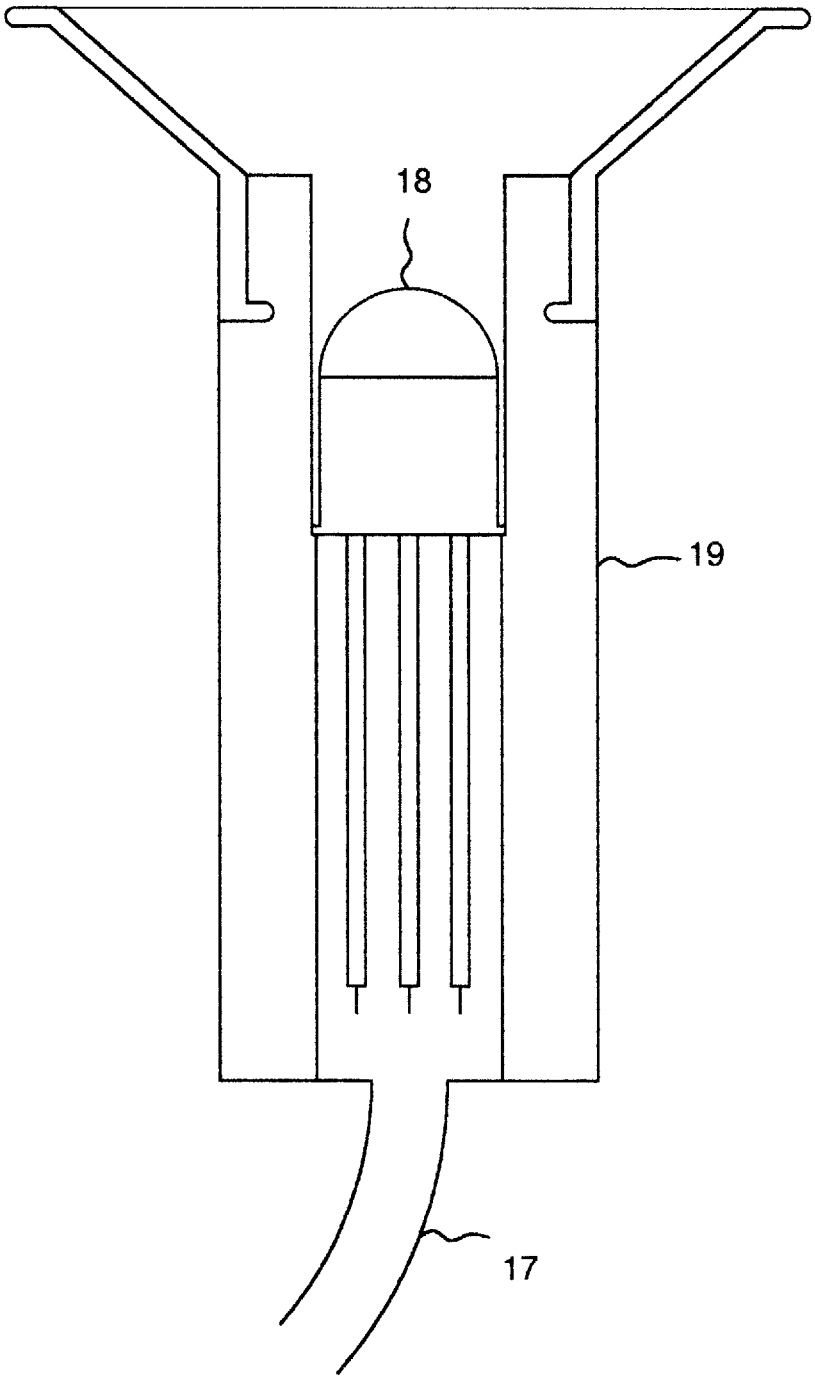

FIG. 6: shows a section view of a photo-sensor cord, a photo-sensor diode element, and a suction-cup attachment device.

Figure 7:
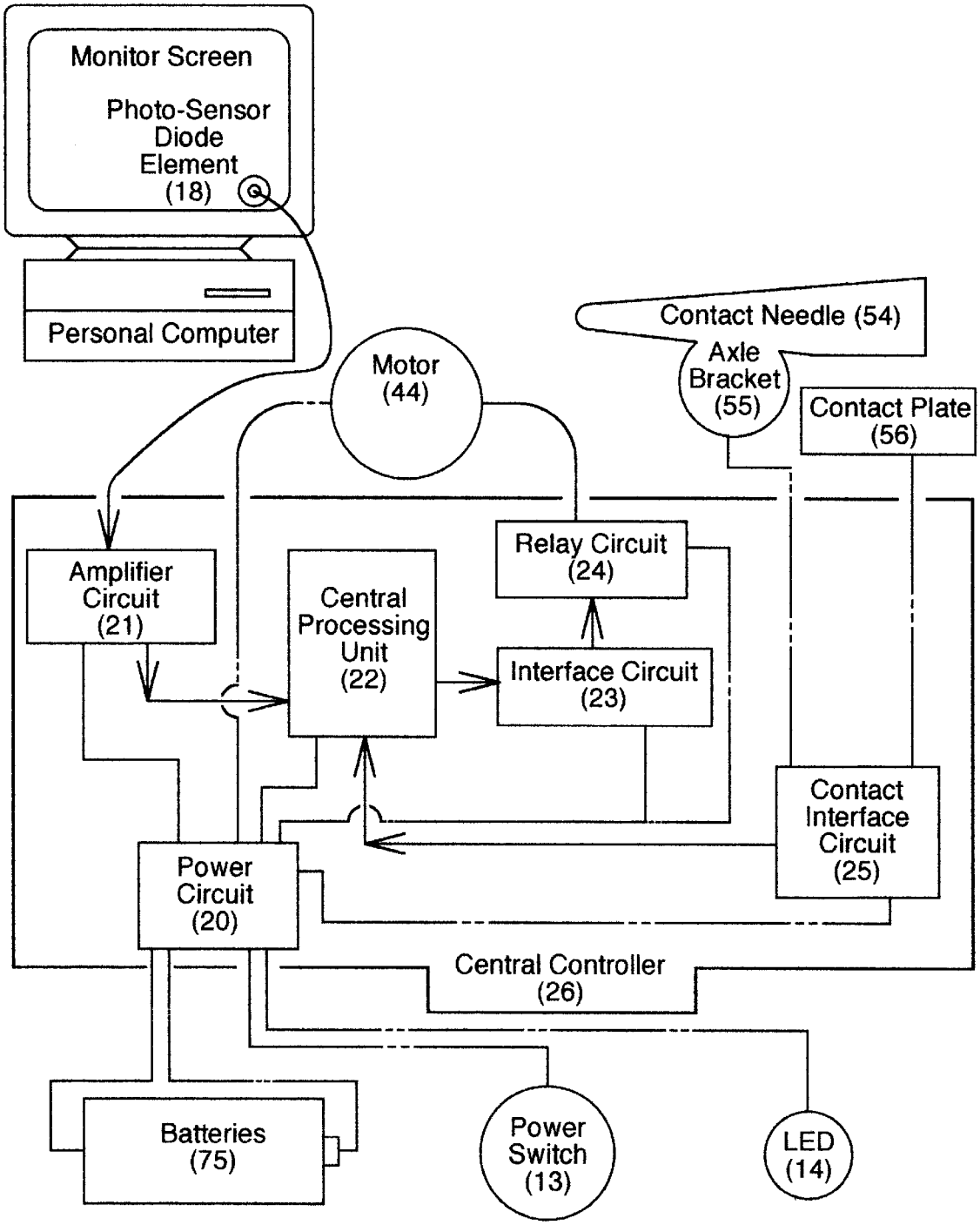

FIG. 7: shows a system flow chart of the operations of a central controller.

Figure 8:
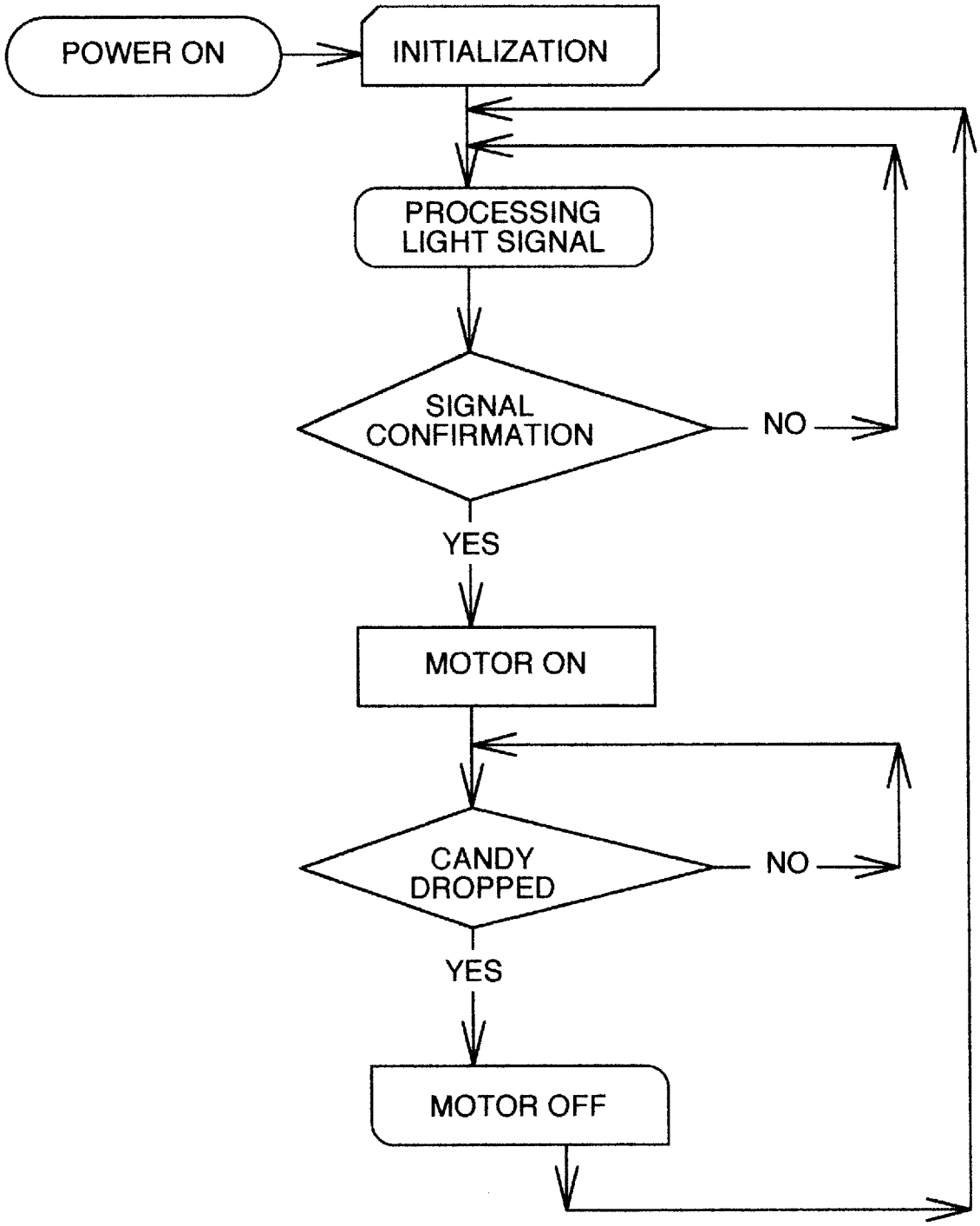

FIG. 8: shows the logic flow chart for the central processing unit of the central controller.

REFERENCE NUMERALS IN DRAWINGS

11 Cap
12 Supply Compartment
13 Power On/Off Switch
14 Light Emitting Diode
15 Component Compartment Base Stand
16 Battery Compartment
17 Photo-sensor Cord
18 Photo-sensor Diode Element
19 Suction-cup Attachment Device
20 Power Circuit
21 Amplifier Circuit
22 Central Processing Unit
23 Interface Circuit
24 Relay Circuit
25 Contact Interface Circuit

26 Central Controller (Compromises Components 20–25)
28 Funnel Base
29 Drum Recess
30 Chute Ceiling
32 Dispense Drum
33 Drum Shaft Hole
34 Load Chambers
36 Agitator Rods
37 Shaft Sleeve
38 Spacer Washer
39 Spacer Washer
40 Drum Gear
41 Drum Gear Shaft
42 Motor Gear
44 Motor
46 Motor Mount Bracket
48 Drop Chute
50 Chute Pipe
52 Mounting Bracket
53 Slot Opening
54 Contact Needle
55 Axle Bracket
56 Contact Plate
60 Dispense Port Hole
62 Dispense Port
65 Service Plate
75 Batteries
100 Representative Candy

SUMMARY

In accordance with the present invention a personal computer peripheral, battery powered reward candy dispenser which compromises: a transparent plastic upper supply compartment with a transparent plastic threaded cap and a transparent plastic lower component compartment base stand; a suction-cup, monitor screen attachable photo-sensor device for detecting a designated personal computer generated light intensity actuation signal; a central controller for receiving, confirming and converting the actuation signal into a dispense motor activation command; a motor and a transparent plastic gear device for rotating a gravity-fed, multiple-chambered, transparent plastic dispense drum under a transparent plastic chute ceiling and above a transparent plastic drop chute for controlled dispense; integral dispense drum agitator rods for agitating stored candies and preventing the formation of bridging cavities; a pivoting, drop contact displacement device for detecting the dispense of a single candy and signaling the central controller to terminate power to the motor; a transparent plastic dispense port for the reception of the reward candies; for the purpose of rewarding and entertaining students, and increasing the utilization and effectiveness of personal computer operated educational software.

Description-FIGS. 1–8

A typical embodiment of the reward candy dispenser of the present invention is illustrated in FIG. 1A (front view), FIG. 1B (side view), FIG. 1C (back view), and FIG. 1D (top view). The present embodiment of this invention is for the controlled dispense of hard candies of the same 10 mm diameter in which a single candy 100 is dispensed per operation. Candies of other size or shape of same dimensions can be used with other embodiments of this invention. All non-electrical components of the present embodiment of this invention are made from transparent molded thermoplastics unless otherwise specified.

The reward candy dispenser has a threaded cap 11. Cap 11 typically has dimensions of 145 mm diameter×25 mm height (cylindrical). Cap 11 is threaded for screwing onto the top of a supply compartment 12. Cap 11 is removed for accessing, cleaning and resupplying candies 100 into supply compartment 12. Supply compartment 12 typically has dimensions of 130 mm diameter×120 mm height (cylindrical). The top of supply compartment 12 is threaded for receiving cap 11. Supply compartment 12 stores a plurality of candies 100. Supply compartment 12 is mated to the top rim of a component compartment base stand 15. Component compartment base stand 15 houses the dispense mechanisms and electrical components and serves as the dispenser stand. Component compartment base stand 15 typically has dimensions of 150 mm width×150 mm length×100 mm height (rectangular). On the bottom center of component compartment base stand 15 is a removable service plate 65 for accessing component compartment base stand 15 if service or repair is needed, FIG. 1A–1D.

On the front of component compartment base stand 15 is an opaque button power switch 13 for turning on and off the reward candy dispenser power. Below power switch 13 is a light emitting diode 14 for displaying that the power is on. A dispense port 62 is mated to the bottom front of component compartment base stand 15. Dispense port 62 typically has dimensions of 25 mm width×25 mm length×12.5 mm height with a 12.5 mm radius quarter-sphere front. Through component compartment base stand 15 is a dispense port hole 60 typically centered with half of its opening above the top rim of dispense port 62. Dispense port hole 60 has a typical diameter of 14 mm, FIG. 1A.

On the back of component compartment base stand 15 is a battery compartment 16 which has a lid for accessing to install and replace batteries 75. Also on the back of component compartment base stand 15 is the attachment point of a photo-sensor cord 17. Photo-sensor cord 17 is typically 750 mm in length (entire cord length not shown). At the end of photo-sensor cord 17 is a solid black rubber suction-cup attachment device 19. Suction-cup attachment device 19 has typical dimensions of 20 mm diameter at the suction-cup perimeter, 10 mm at the base, and total length of 29 mm, FIG. 1D and FIG. 6.

Recessed 3 mm deep into the center of the attachment face of suction-cup device 19 is a photo sensor diode element 18. Photo sensor diode element 18 has a lens which is typically 4.7 mm diameter and element length of 18.5 mm, FIG. 6. Suction-cup attachment device 19 secures photo-sensor diode element 18 directly above an actuation signal graphic on a personal computer monitor screen and blocks out interference light. The lens of photo-sensor diode element 18 is recessed to detect the changes in light intensity of the actuation graphic signal only. A typical actuation graphic signal for the present embodiment of this invention is a series of alternating solid black and white graphic spots 25 mm in diameter.

A funnel base 28 is mated to the top rim flange of component compartment base stand 15, and slopes down from the bottom edge of supply compartment 12 forming into an integral cylindrical drum recess 29. Drum recess 29 typically has dimensions of 78 mm diameter×12 mm height. The sloped walls of funnel base 28 ensure that stored candies 100 are forced to roll down by gravity to the lowest point on funnel base 28. Within drum recess 29 rotates a dispense drum 32. Dispense drum 32 is typically 76 mm diameter×9 mm height at perimeter edge×15 mm height at center (flat bottom and double concave top, FIG. 2). The top perimeter edge of dispense drum 32 is 2 mm below the top edge of drum recess 29. Dispense drum 32 has four equidistantly spaced load chambers 34. Load chambers 34 typically have 12 mm diameter openings. The double concave shaped top of dispense drum 32 allows candies 100 to be forced to fall down into load chambers 34 by gravity. Once fallen into load chambers 34, the bottom of candies 100 sit upon the floor of drum recess 29 with the top of candies 100 flush with the top perimeter edge of dispense drum 32. Typically, the radius from the longitudinal axis of dispense drum 32 to the center of load chambers 34 is 28 mm, as well, the radius from the longitudinal axis of dispense drum 32 to the center of a drop chute 48 opening is also 28 mm. Drop chute 48 typically has a 13 mm diameter opening and is located on the floor of drum recess 29 below dispense drum 32, FIG. 2.

A drum gear 40 has an integral drum gear shaft 41 protruding from the center of its top. Drum gear 40 is typically 36 mm diameter×4 mm height. Drum gear shaft 41 typically has dimensions of 5 mm diameter×12 mm length with a threaded tip. Drum gear shaft 41 rotates in a shaft sleeve 37. Shaft sleeve 37 protrudes down from the bottom center of drum recess 29 and is an integral part of drum recess 29. The threaded tip of drum gear shaft 41 fastens into a threaded drum shaft hole 33. Drum shaft hole 33 is located on the bottom center of dispense drum 32. Shaft sleeve 37 maintains the rotation of drum gear shaft 41 around its longitudinal axis. Between the bottom of dispense drum 32 and the floor of drum recess 29 is a metal spacer washer 38 with dimensions of 10 mm diameter×1 mm height. Spacer washer 38 elevates dispense drum 32 1 mm above the floor of drum recess 29 and facilitates smooth rotation of dispense drum 32. Between the top of drum gear 40 and bottom of shaft sleeve hole 37 is a metal spacer washer 39 with dimensions of 10 mm diameter×1 mm height. Spacer washer 39 prevents dispense drum 32 from rising and facilitates smooth rotation of dispense drum 32, Drum gear 40 is in constant contact with, and driven by a motor gear 42. Motor gear 42 is typically 5 mm diameter×4 mm height. Dispense drum 32 is rotated by a motor 44, motor gear 42, and drum gear 40. Motor 44 is held in position by a motor mount bracket 46. Motor mount bracket 46 is attached to battery compartment housing 16. Motor 44 rotates dispense drum 32 so that load chambers 34 are brought directly centered atop of drop chute 48 and loaded candy 100 is forced to fall through drop chute 48 opening and into a chute pipe 50 by gravity. While dispense drum 32 rotates, candies 100 in load chambers 34 roll and slide across the floor of drum recess 29 before entering the opening of drop chute 48, FIG. 2 and FIG. 4.

The opening of drop chute 48 is larger than the opening of load chambers 34 to allow for play and prevent the candy from being wedged between the bottom edge of load chambers 34 and the top edge of drop chute 48 during the candy 100 drop and momentary continuing rotation of dispense drum 32. Chute pipe 50 mates over drop chute 48 and elbows down, mating to the inner face of component compartment base stand 15 around dispense port hole 60. The inner diameter of chute pipe 50 is typically 15 mm diameter. Chute pipe 50 guides the falling candy 100 from drop chute 48 to dispense port 62, FIG. 2, FIG. 3, FIG. 4, and FIG. 5.

An integral chute ceiling 30 extends horizontally from funnel base 28 typically 3 mm above the top perimeter edge of dispense drum 32. Chute ceiling 30 is center aligned over the top of the opening of drop chute 48. Chute ceiling 30 typically has dimensions of 14 mm width×26 mm length×2 mm thick. Chute ceiling 30 has rounded edges to prevent catching or jamming of candies 100 not in load chambers 34 but riding atop of rotating dispense drum 32. Chute ceiling 30 prevents candies 100 stored in supply compartment 12 from falling into drop chute 48. Only the candy in the rotated load chamber 34 directly under chute ceiling 30 can fall into the opening of drop chute 48, FIG. 2.

Protruding at angle from the curved top of dispense drum 32 are two integral agitator rods 36. When dispense drum 32 is rotated, agitator rods 36 mix candies 100 stored in supply compartment 12 and prevent candy bridging/caving above load chambers 34. Agitator rods 36 dimensions are typically 3 mm diameter×8 mm length, FIG. 2 and FIG. 4.

On the exterior of chute pipe 50 is an integral mounting bracket 52. Mounting bracket 52 has typical dimensions of 15 mm width×11 mm height×2 mm thick. Adjacent to mounting bracket 52 is a slot opening 53 through chute pipe 50. Slot opening 53 typically has dimensions of 3 mm width×5 mm height (oval). Mated to the base of mounting bracket 52 is a metal contact plate 56. Contact plate 56 typically has dimensions of 2 mm width×6 mm length×2 mm thick. Contact plate 56 is connected to an electric wire (connection not shown). Resting upon the top of metal contact plate 56 is the metal weighted portion of a contact needle 54. The weighted portion of contact needle 54 has typical dimensions of 3 mm width×7 mm length×3 mm thick. The needle portion of contact needle 54 0.5 mm diameter×8 mm length. Contact needle 54 is hinged off-balance so that the weighted portion sits upon contact plate 56. The needle portion of contact needle 54 passes through slot opening 53 and into chute pipe 50, directly under the center of drop chute 48. Contact needle 54 pivotably rotates in a limited arc around, and in continuous contact with a metal axle bracket 55, FIG. 3 and FIG. 5. The rotational arc of contact needle 54 is limited by the top surface of metal contact plate 56 and the bottom edge of slot opening 53. Axle bracket 55 is inserted through, and mated to mounting bracket 52. The axle portion of axle bracket 55 is typically 1 mm diameter×6 mm length with a flared end for preventing contact needle 54 from falling off. The bracket portion of axle bracket 54 is on the opposite side of mounting bracket 52 and is typically 3 mm width×7 mm length×1 mm thick. The bracket portion of axle bracket 55 is connected to an electrical wire completing an electrical connection through contact needle 54 with contact plate 56 (connection not shown). The weighted end of contact needle 54 is displaced from contact plate 56 when a candy 100 drops through drop chute 48 and strikes the needle portion of contact needle 54, FIG. 3 and FIG. 5.

A central controller 26 is attached to the interior wall of component compartment base stand 15 and compromises a power circuit 20, an amplifier circuit 21, a central processing unit 22, an interface circuit 23, a relay circuit 24 and a contact interface circuit 25. Conventional electric terminals, wires, and connections are not shown in the figures for sake of clarity and brevity, such as: battery terminals and wire connections to central controller 26; terminals and wire connections from motor 44 to central controller 26; terminals and wire connections from contact plate 56 and axle bracket 55 to central controller 26; terminal and wire connections from photo-sensor diode 18 to central controller 26; terminals and wire connections from power switch 13 and light emitting diode 14 to central controller 26; and terminals and wire connections within central controller 26. The system process flow for central controller 26 is shown in FIG. 7 and logic flow for central processing unit 22 shown in FIG. 8.

The actuation graphic signal is sent from photo-sensor diode element 18 through photo-sensor chord 17 and amplified by amplifier circuit 21 to central processing unit 22.

Central processing unit 22 processes the signal and confirms whether the signal is affirmative. If the signal is affirmative, central processing unit 22 sends a command signal through interface circuit 23 to relay circuit 24, to activate power to motor 44 and commence rotation of dispense drum 32 and the dispense process. If the signal is negative, central processing unit 22 does not send the command signal and resets itself to receive the next actuation signal. Contact interface circuit 25 is connected to contact plate 56 and axle bracket 55 (connection not shown). Contact interface circuit 25 notifies central processing unit 22 of candy 100 drop displacement of contact needle 54 and central processing unit 22 stops the command signal to interface circuit 23, thereby terminating power to motor 44 and stopping rotation of dispense drum 32. Central processing unit 22 then resets itself for the next operation. The electric power is controlled and distributed from batteries 75 to the electrical components by electric power circuit 20, FIG. 7 and FIG. 8.

Operation-FIGS. 1–8

The reward candy dispenser must be utilized with educational software applications which have incorporated the designated actuation graphic signal in the software design for problems answered correctly. Software should include a 25 mm cylindrical border icon usually in the bottom corner of the monitor screen or in the most convenient location on the screen for that particular software graphic environment. This icon lets the students know the location on the monitor screen where they must attach suction-cup attachment device 19 to detect the actuation graphic signal.

For the present embodiment of this invention, a typical affirmative actuation graphic signal called "A" is a 25 mm diameter alternating solid black and white graphic with the following sequence:

No signal white, Signal Commence→black 0.1 seconds→white 0.1 seconds→black 0.5 seconds→white 0.1 seconds→black 0.1 seconds→Signal Ends with No signal white.

After batteries 75 have been installed and supply compartment 12 filled with candies 100, students can begin utilizing the reward candy dispenser by placing it on a convenient flat location next to the personal computer, attaching suction-cup attachment device 19 within the cylindrical border icon on the monitor screen, and pressing power switch 13 on. After power switch 13 is turned on, light emitting diode 14 will illuminate to display that power is on and batteries 75 charged, and central processing unit 22 will commence its initialization process to prepare for first dispense operation.

Immediately after a question is answered correctly during the course of the educational application software exercise, photo-sensor element 18 detects and sends the designated actuation signal to central controller 26. Central controller 26 confirms the signal and activates motor 44 to begin rotating dispense drum 32 counter-clockwise. Motor 44 continues to rotate dispense drum 32 at a typical speed of 0.2 rotations per second and agitator rods 36 agitate candy supply contents 100 until one candy has fallen through drop chute 48 and displaced contact needle 54 from metal contact plate 56. Central controller 26 then stops power to motor 44 and resets for the next operation. After displacement by the fallen candy, contact needle 54 returns by its own weighted end to its sitting position atop contact plate 56. The candy 100 falls and roles to dispense port 62 where it can be received by students.

Students can see the mechanical processes during the dispense operation because of the transparent compartments and components. Through this visual effect students will be more aware of the effect of their correct responses to the questions. Students will be motivated to continue answering questions to receive more candy as well as to watch the visible dispense processes. Students finish by shutting off power switch 13 and removing suction-cup attachment device 19 from the monitor screen. The candy 100 supply and batteries 75 must be replenished as necessary.

SUMMARY, RAMIFICATIONS, AND SCOPE

Accordingly, the reader will see that my invention will be simple and safe to operate, as well as interesting, intriguing, rewarding and beneficial for students when studying with educational software applications that have included the designated actuation graphic signal. Furthermore, my invention has the additional advantages in that:

(a) it provides teachers and parents a new means for motivating students;

(b) it provides teacher and parent software makers the flexibility to simply include the actuation graphic signal in their own home-made educational software programs.

(c) it allow students to experience first hand mechanical processes and cause-effect relationships particularly in terms of effort and reward through the learning process.

Although the description above contains many specificities, these should not be construed as limiting the scope of the invention but as merely providing illustrations of some of the presently preferred embodiments of this invention. For example the reward candy dispenser could:

(a) have a base stand compartment, dispense port, or cap with different shapes, levels of transparency, or portions colored or translucent;

(b) have a dispense drum mechanism designed for different type shape/size of same dimensioned candies, such as an oval shaped candy with size smaller/greater than 10 mm;

(c) have different size dispense drum, gears, or increased /decreased number of load chambers;

(d) have a photo-sensor element with integral amplifier or smaller/larger size depending on newer type photo-sensor elements entering the market;

(e) have a direct current power adaptor and plug for older students where safety is not a concern;

(f) have a different actuation signal graphic series or reduced size depending on new type photo-sensor elements entering the market; etc.

Thus the scope for the invention should be determined by the appended claims and their legal equivalents, rather than by the examples given.

I claim:

1. A personal computer peripheral, battery powered reward candy dispenser for use with educational application software compromising:

a) a transparent plastic upper supply compartment with a transparent threaded plastic cap for storing a plurality of the same size candies, b) a transparent plastic lower compartment base stand for housing the dispenser components, c) a suction-cup, monitor screen attachable photo-sensor device for detecting a designated personal computer generated light intensity actuation signal, d) a central controller for receiving, confirming, and converting said actuation signal into a dispense motor activation command, e) a motor and transparent plastic gear means for rotating a transparent plastic, gravity-fed, multiple-chambered dispense drum under a transparent plastic chute ceiling and above a transparent plastic drop chute for controlled dispense, f) integral agitator rods on said dispense drum for agitating stored said candies and preventing the formation of bridging cavities in said supply compartment above said chambered dispense drum, g) a pivoting, drop contact displacement device for detecting the dispense of one said candy and signaling said central controller to stop power to said motor limiting said controlled dispense to one said candy per said actuation signal, h) a transparent plastic dispense port for reception of a plurality of dispensed said candies, i) a main power switch and a light emitting diode to display that said power switch is on, whereby said candy reward dispenser will entertain and intrigue students with visible dispense processes, and whereby said candy reward dispenser will present students with a single said candy for each problem answered correctly thereby rewarding the students and motivating continued utilization and increased effectiveness of said educational application software.

* * * * *